US007945196B2

(12) United States Patent
Ebe

(10) Patent No.: US 7,945,196 B2
(45) Date of Patent: May 17, 2011

(54) DEVELOPING DEVICE WITH SUPPLY MEMBER AND IMAGE FORMING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 213 days.

(21) Appl. No.: 12/318,595

(22) Filed: Dec. 31, 2008

(65) Prior Publication Data

US 2009/0185837 A1 Jul. 23, 2009

(30) Foreign Application Priority Data

Jan. 23, 2008 (JP) ..... 2008-013170

(51) Int. Cl.
*G03G 15/08* (2006.01)

(52) U.S. Cl. ..... 399/286; 399/281

(58) Field of Classification Search ..... 399/258, 399/286, 272, 281
See application file for complete search history.

(56) References Cited

U.S. PATENT DOCUMENTS

2007/0098459 A1* 5/2007 Endo et al. ..... 399/281

FOREIGN PATENT DOCUMENTS

| | | |
|---|---|---|
| JP | 10-186834 | 7/1998 |
| JP | 11-327283 | 11/1999 |
| JP | 2003-313330 | 11/2003 |
| JP | 2005-141192 | 6/2005 |
| JP | 2005-283995 | 10/2005 |
| JP | 2006-243358 | 9/2006 |

* cited by examiner

*Primary Examiner* — Susan S Lee
(74) *Attorney, Agent, or Firm* — Kubotera & Associates LLC

(57) ABSTRACT

A developing device includes a developer supporting member having an elastic layer and a surface layer, and a supply member for supplying developer to the developer supporting member. The surface layer is formed of a mixture containing at least an acrylic resin and a polyether type urethane resin. The developer supporting member and the supply member are configured so that the following equations are satisfied:

$$20 \leqq A1 \leqq 80$$

$$0.6 \leqq D \leqq 2.0$$

$$45 + 0.1 \times A1 \times D \leqq F \times N \leqq 65$$

where A1 is a weight ratio (%) of the acrylic resin relative to a total weight of the acrylic resin and the polyether type urethane resin, F is an Asker F hardness (degree) of a surface of the supply member, and N is an overlap amount (mm) representing a biting amount of the supply member relative to the developer supporting member.

6 Claims, 13 Drawing Sheets

DEVELOPING DEVICE WITH SUPPLY MEMBER AND IMAGE FORMING APPARATUS

BACKGROUND OF THE INVENTION AND RELATED ART STATEMENT

The present invention relates to a developing device and an image forming apparatus having the developing device.

A conventional developing device is provided with a developer supporting member for developing a static latent image formed on an image supporting member using developer. The developer supporting member includes a surface layer formed of a urethane resin and disposed on a conductive elastic layer (refer to Patent Reference).

Patent Reference: Japanese Patent Publication No. 10-186834

In the conventional developing device, the developer supporting member or a developing roller is disposed to abut against a component such as a transport member for transporting developer. When the developer supporting member includes the surface layer formed of a urethane resin, the developer supporting member abuts against the component with a large frictional force, thereby deteriorating developer, or causing an image quality problem such as fog and stain.

In view of the problems described above, an object of the present invention is to provide a developing device and an image forming apparatus, in which it is possible to solve the problems in the conventional developing device. In the present invention, even when a developer supporting member contacts with a developer supply member for supplying developer to the developer supporting member, it is possible to prevent developer from deteriorating, and to prevent an image quality problem such as fog and stain due to friction between the developer supporting member and the developer supply member.

Further objects and advantages of the invention will be apparent from the following description of the invention.

SUMMARY OF THE INVENTION

In order to attain the objects described above, according to a first aspect of the present invention, a developing device includes a developer supporting member having an elastic layer and a surface layer covering the elastic layer, and a supply member contacting with the developer supporting member for supplying developer to the developer supporting member. The surface layer is formed of a mixture containing at least an acrylic resin and a polyether type urethane resin. The developer supporting member and the supply member are configured so that the following equations are satisfied:

$$20 \leqq A1 \leqq 80$$

$$0.6 \leqq D \leqq 2.0$$

$$45+0.1 \times A1 \times D \leqq F \times N \leqq 65$$

where A1 is a weight ratio (%) of the acrylic resin relative to a total weight of the acrylic resin and the polyether type urethane resin, F is an Asker F hardness (degree) of a surface of the supply member, and N is an overlap amount (mm) representing a biting amount of the supply member relative to the developer supporting member.

In the first aspect of the present invention, when developer supporting member and the supply member are configured so that the above equations are satisfied, it is possible to provide an image forming apparatus capable of forming a high quality image with less fog, stain, and filming.

According to a second aspect of the present invention, a developing device includes a developer supporting member having an elastic layer and a surface layer covering the elastic layer, and a supply member contacting with the developer supporting member for supplying developer to the developer supporting member. The surface layer is formed of a mixture containing at least an acrylic resin and a polyester type urethane resin. The developer supporting member and the supply member are configured so that the following equations are satisfied:

$$40 \leqq A2 \leqq 80$$

$$0.6 \leqq D \leqq 2.0$$

$$45+0.1 \times A2 \times D \leqq F \times N \leqq 65$$

where A2 is a weight ratio (%) of the acrylic resin relative to a total weight of the acrylic resin and the polyester type urethane resin, F is an Asker F hardness (degree) of a surface of the supply member, and N is an overlap amount (mm) representing a biting amount of the supply member relative to the developer supporting member.

In the second aspect of the present invention, when the surface layer is formed of the mixture containing at least the acrylic resin and the polyester type urethane resin, it is possible to increase a mechanical strength of the surface layer. When the developer supporting member and the supply member are configured so that the above equations are satisfied, it is possible to provide an image forming apparatus capable of forming a high quality image with less fog, stain, and filming.

According to a third aspect of the present invention, an image forming apparatus includes the developing device described above. Accordingly, it is possible to provide the image forming apparatus capable of forming a high quality image.

DETAILED DESCRIPTION OF PREFERRED EMBODIMENTS

Hereunder, embodiments of the present invention will be explained with reference to the accompanying drawings. In the present invention, an image forming apparatus is provided with a developing device having a developing roller as a developer supporting member.

Figure 1:
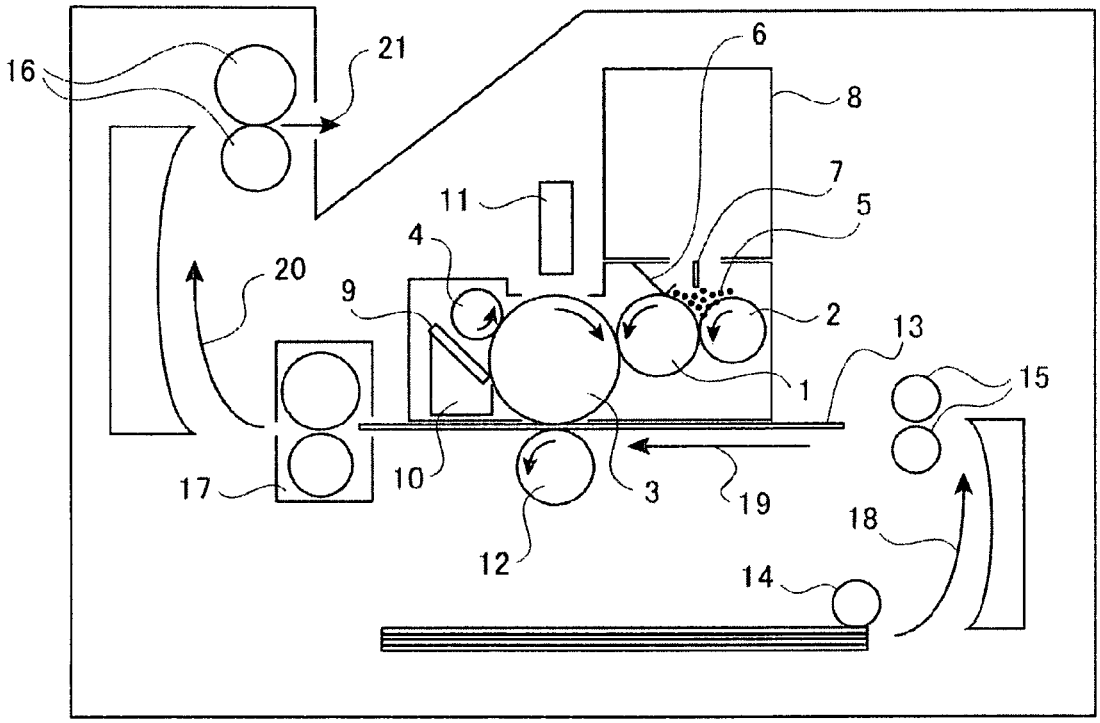
FIG. 1 is a schematic view showing a developing device and an image forming apparatus according to an embodiment of the present invention.
Figure 2:
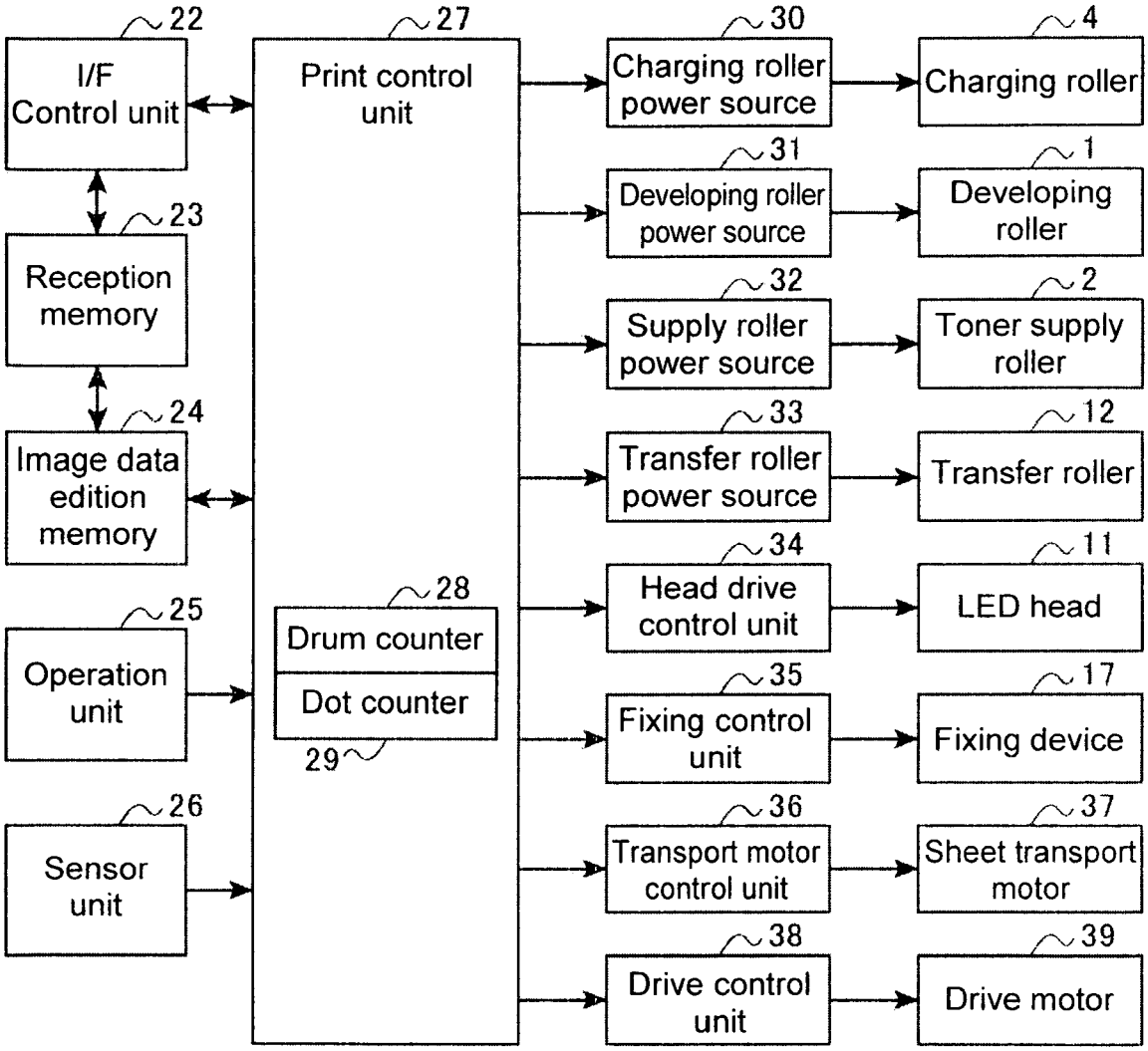
FIG. 2 is a block diagram showing a control system of the image forming apparatus according to the embodiment of the present invention.

The image forming apparatus will be explained first. FIG. 1 is a schematic view showing the developing device and the image forming apparatus according to an embodiment of the present invention. FIG. 2 is a block diagram showing a control system of the image forming apparatus according to the embodiment of the present invention.

In the embodiment, the image forming apparatus includes an image forming unit arranged to be detachable relative to the image forming apparatus. The image forming unit includes a photosensitive drum 3 as an image supporting member; a charging roller 4 as a charging device for charging the photosensitive drum 3; a developing device for developing a static latent image formed on the photosensitive drum 3 with toner 5 as developer to form a toner image as a developer image; a cleaning blade 9 for scraping off toner remaining on the photosensitive drum 3 or fog toner on the photosensitive drum 3 after the toner image is transferred from the photosensitive drum 3 to a sheet 13 as a recording medium; and a toner collection box 10 for collecting remaining toner and fog toner thus scraped off. A spiral (not shown) is disposed in the toner collection box 10 for collecting waste toner.

In the embodiment, the developing device of the image forming unit retains the toner 5. The developing device includes a toner cartridge 8 detachably attached to the image forming unit; a developing roller 1 as a developer supporting member disposed to face the photosensitive drum 3 for developing a static latent image on the photosensitive drum 3; a toner supply roller 2 as a supply member for supplying the toner 5 to the developing roller 1; a developing blade 6 as a toner layer regulation member for forming a thin layer of the toner 5 supplied to the developing roller 1; and a stirring member 7 for maintaining flowability of the toner 5 in the developing device.

In the embodiment, the toner 5 includes any types capable of developing a static latent image such as, for example, negatively charged crashed toner of a non-magnetic one component type using a polyester resin as a binder resin and having a glass transition temperature of 60° C. to 65° C. and a softening point of 110° C. to 117° C. The developing blade 6 includes any types capable of forming a thin layer of the toner 5 on the developing roller 1, and may be formed of a SUS plate having a thickness of 0.08 mm and a curved portion with a radius of curvature of 0.2 mm for contacting with the developing roller 1.

As shown in FIG. 1, the developing roller 1, the toner supply roller 2, the photosensitive drum 3, and the charging roller 4 are disposed to be rotatable in arrow directions, and the photosensitive drum 3 and the toner supply roller 2 abut against the developing roller 1. The photosensitive drum 3 has an outer diameter of, for example, 24 mm, and rotates at a circumferential speed of, for example, 93.7 mm/s. The developing roller 1 has an outer diameter of, for example, 14.0 mm; bits into the photosensitive drum 3 by, for example, 0.1 mm; and rotates at a circumferential speed ratio of, for example, 1.39 (a circumferential speed of 130.2 mm/s) relative to the photosensitive drum 3. The charging roller 4 follows the photosensitive drum 3 to rotate. The toner supply roller 2 rotates at a circumferential speed ratio of, for example, 0.90 (a circumferential speed of 84.3 mm/s) relative to the photosensitive drum 3, and is arranged such that a center thereof is apart from that of the developing roller 1 by a center distance (distance between rotational axes of the rollers) of 12.7 mm. The circumferential speed is defined as a linear speed at an outer circumference of the roller or the drum in a tangential direction.

In the embodiment, the image forming apparatus further includes sheet transport rollers 14, 15, and 16 for transporting the sheet 13; an LED (Light Emitting Diode) head 11 as an exposure device for exposing a surface of the photosensitive drum 3 to form a static latent image; a transfer roller 12 rotating in an arrow direction shown in FIG. 1 to transfer the toner image formed on the photosensitive drum 3 to the sheet 13; and a fixing device 17. The fixing device 17 includes a heating roller with a heating member (not shown) for melting the toner image transferred to the sheet 13 with the transfer roller 12, and a pressing roller for pressing the sheet 13 thus transported together with the heating roller. The heating roller is provided with a heater (not shown) for melting the toner image transferred to the sheet 13, and a temperature sensor for detecting a temperature of the heater.

As shown in FIG. 2, the image forming apparatus further includes a print control unit 27; a drum counter 28; a dot counter 29; an interface (I/F) control unit 22; a reception memory 23; an image data edition memory 24; an operation unit 25; a sensor unit 26; a charging roller power source 30; a developing roller power source 31; a supply roller power source 32; a transfer roller power source 33; a head drive control unit 34; a fixing control unit 35; a transport motor control unit 36; and a drive control unit 38.

In the embodiment, the print control unit 27 is formed of a microprocessor, an ROM (Read Only Memory), an RAM (Random Access Memory), an input port, a timer, and the likes for controlling the drum counter 28 to count a rotational number of the photosensitive drum 3 and the dot counter 29 to count printed dots. Further, the print control unit 27 receives print data and a control command from a host device through the interface (I/F) control unit 22, and controls an image forming operation as a whole to execute a printing operation.

In the embodiment, the reception memory 23 temporarily stores the print data and the control command received through the interface (I/F) control unit 22. The image data edition memory 24 receives the print data stored in the reception memory 23, and edits the print data to store image data thus created.

In the embodiment, the operation unit 25 includes an LED for displaying a status of the image forming apparatus, and a switch and a display unit for an operator to input a direction to the image forming apparatus. The sensor unit 26 is formed of various sensors (not shown) such as a sheet position detection sensor, a temperature/humidity sensor, a density sensor, and the likes for monitoring an operational state of the image forming apparatus.

In the embodiment, the charging roller power source 30 applies a specific voltage to the charging roller 4; the developing roller power source 31 applies a specific voltage to the developing roller 1; the supply roller power source 32 applies a specific voltage to the toner supply roller 2; and the transfer roller power source 33 applies a specific voltage to the transfer roller 12. Note that the charging roller power source 30, the developing roller power source 31, and the supply roller power source 32 are capable of changing the specific voltages according to a direction of the print control unit 27.

In the embodiment, the head drive control unit 34 drives and controls the LED head 11, and sends the image data stored in the image data edition memory 24 to the LED head 11. The fixing control unit 35 retrieves an output of the temperature sensor (not shown) of the fixing device 17, and controls the heater according to the output to maintain a temperature of the fixing device 17 at a constant level. The transport motor control unit 36 controls a sheet transport motor 37 to drive or stop the sheet transport rollers 14, 15, and 16 for transporting the sheet 13 in arrow directions 18, 19, and 20 shown in FIG. 1, respectively. The drive control unit 38 controls a drive motor 39 to rotate the photosensitive drum 3 in the arrow direction shown in FIG. 1, thereby rotating the charging roller 4, the developing roller 1, and the toner supply roller 2 in the arrow directions shown in FIG. 1.

In the image forming apparatus, the print data received at the interface (I/F) control unit 22 are stored in the reception memory 23, and the print control unit 27 controls an entire sequence of the image forming apparatus to perform the printing operation. After the print data are received, the print control unit 27 controls the transport motor control unit 36 to drive the sheet transport roller 14 with the sheet transport motor 37, thereby rolling up the sheet at a specific timing and transporting the sheet 13 in the arrow direction 18. Then, the sheet transport motor 37 drives the sheet transport roller 15 to transport the sheet 13 to the image forming unit. After the sheet 13 passes through the sheet transport roller 15, the sheet 13 is transported between the image forming unit and the transfer roller 12 in the arrow direction 19 at a timing capable of transferring the toner image formed with the image forming unit.

At this moment, the image forming unit forms the toner image. In the image forming process, first, the print control unit 27 sends control data to the drive control unit 38. Upon receiving the control data, the drive control unit 38 controls the drive motor 39 to rotate the photosensitive drum 3. When the charging roller power source 30 applies a negative voltage to the charging roller 4 rotating with the photosensitive drum 3, the surface of the photosensitive drum 3 is charged.

In the embodiment, the image data edition memory 24 converts the print data stored in the reception memory 23 to the image data. The image data thus converted are sent to the head drive control unit 34 through the print control unit 27. The head drive control unit 34 controls the LED head 11 according to the image data thus received, so that the LED head 11 exposes the surface of the photosensitive drum 3. Accordingly, the static latent image corresponding to the image data is formed on the surface of the photosensitive drum 3 thus charged.

Further, the print control unit 27 directs the specific voltages to be applied to the developing roller 1 and the toner supply roller 2 rotating with the photosensitive drum 3. The stirring member 7 stirs and supplies the toner 5 retained in the toner cartridge 8 to the toner supply roller 2, so that the toner supply roller 2 supplies the toner 5 to the developing roller 1. When the toner 5 passes through the developing blade 6, a thin layer of the toner 5 is formed on the developing roller 1. The static latent image formed on the surface of the photosensitive drum 3 is developed with the thin layer of the toner 5 on the developing roller 1, thereby forming the toner image on the photosensitive drum 3.

Before the sheet 13 passes through between the image forming unit and the transfer roller 12, the transfer roller power source 33 applies the specific voltage to the transfer roller 12. Accordingly, when the sheet 13 passes through between the photosensitive drum 3 and the transfer roller 12, the toner image is transferred to the sheet 13 at a pressing portion between the photosensitive drum 3 and the transfer roller 12 through a physical pressure and an electric static force.

After the toner image is transferred to the sheet 13, the sheet 13 passes through the fixing device 17 controlled with the fixing control unit 35, thereby thermally pressing and fixing the toner image to the sheet 13. After the toner image is fixed, the sheet 13 is transported in the arrow direction 20, and the sheet transport roller 16 driven with the sheet transport motor 37 transports the sheet 13 in an arrow direction 21, i.e., outside the image forming apparatus.

In the embodiment, the image forming apparatus includes one image forming unit, and is not limited thereto. The image forming apparatus may include four image forming units corresponding to toner in four colors of black, yellow, magenta, and cyan. The four image forming units are arranged along a transport path from a supply side to a discharge side of the sheet. In this case, the four image forming units transfer toner images in colors at a timing of the sheet 13 transported according to the control of the print control unit 27, thereby obtaining a color image.

Figure 3:
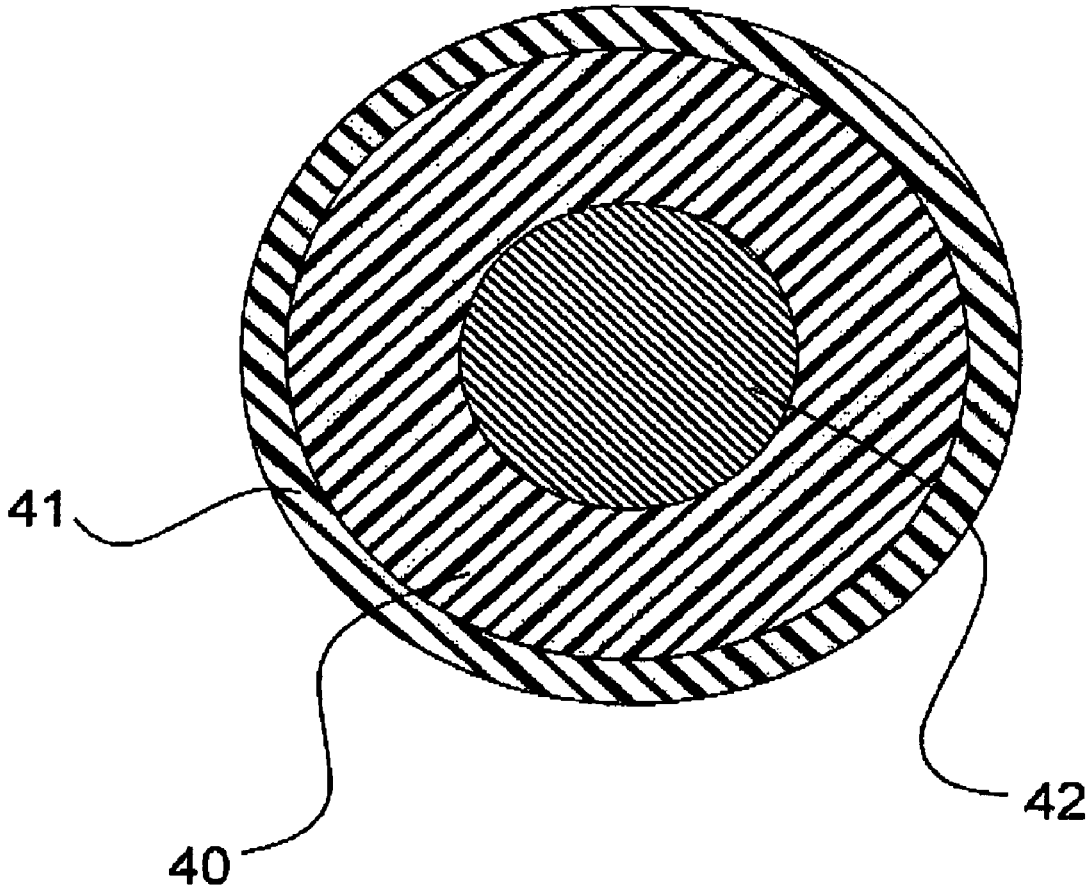
FIG. 3 is a schematic sectional view showing a developing roller of the developing device according to the embodiment of the present invention.

The developing roller 1 will be explained in more detail. FIG. 3 is a schematic sectional view showing the developing roller 1 of the developing device according to the embodiment of the present invention. As shown in FIG. 3, the developing roller 1 includes a shaft metal 42 formed of a conductive material such as SUS; an elastic layer 40 formed on the shaft metal 42; and a surface layer 41 formed on the elastic layer 40 for charging the toner 5.

In the embodiment, the elastic layer 40 is formed of a polyether type urethane resin, and contains an electron conductive agent such as carbon black and insulation inorganic fine particles such as calcium carbonate and silica. The elastic layer 40 has an Asker C hardness of 76 degrees. The Asker C hardness may be measured with an Asker C hardness meter (a product of Kobunshi Keiki Co., Ltd.), in which a contact point of the meter contacts with a top portion of a roller outer circumference.

In the embodiment, the surface layer 41 is formed of a mixture of an acrylic resin and a urethane resin. The acrylic resin of the surface layer 41 may include a polymer obtained through polymerization of derivatives of various acrylic acids or methacrylic acids. When the surface layer 41 is produced, the acrylic resin and the urethane resin are resolved in a solvent, and the solution is coated on the charging roller 4 with a specific method. Then, the solution thus coated is thermally dried to evaporate the solvent, thereby forming the surface layer 41 on the elastic layer 40. The acrylic resin of the surface layer 41 may include a methacrylic acid methyl methacrylic acid copolymer. The urethane the surface layer 41 may include a thermoplastic such as a polyether type urethane resin and a polyester type urethane resin.

In the embodiment, the surface layer 41 may contain carbon black in a range of 0.1 to 10 weight parts relative to 100 weight parts of the resin, so that the surface layer 41 becomes semi-conductive. It is preferred that the developing roller 1 has a surface roughness Rz (JISB0601-1994) of 5 μm to 9 μm. The surface roughness may be measured with Surfcoder SEF3500 (a product of Kosaka Laboratory Ltd.).

Figure 4:
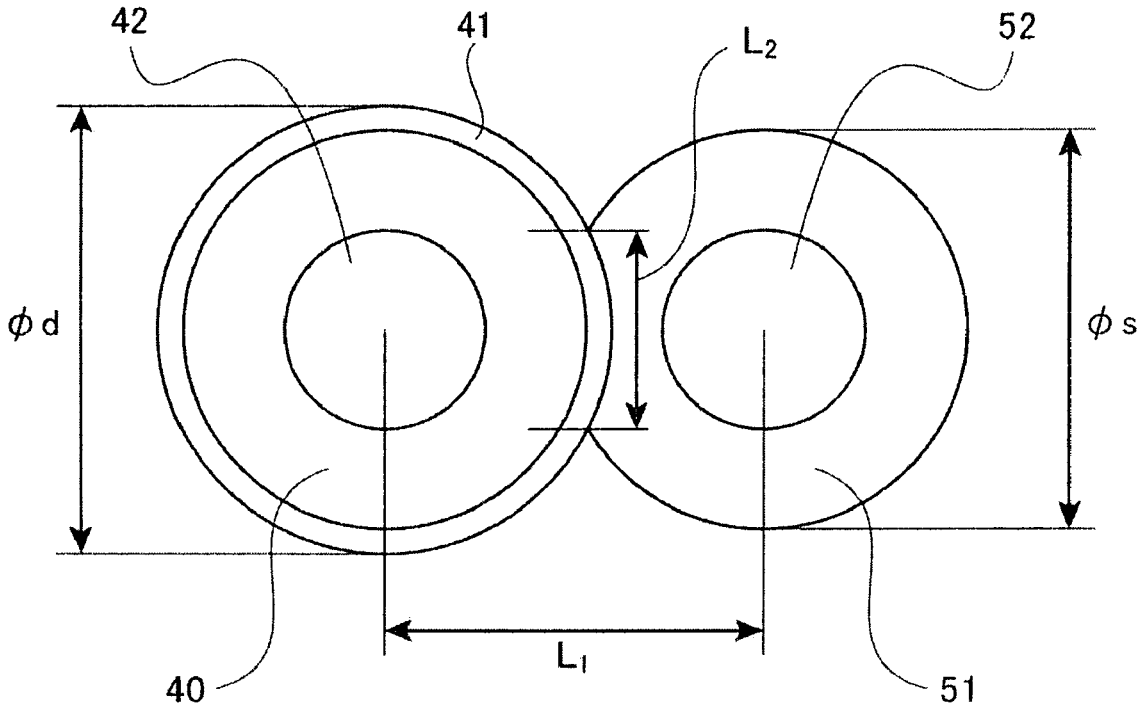
FIG. 4 is a schematic sectional view showing the developing roller and a toner supply roller of the developing device according to the embodiment of the present invention.

FIG. 4 is a schematic sectional view showing the developing roller 1 and the toner supply roller 2 of the developing device according to the embodiment of the present invention. As shown in FIG. 4, the toner supply roller 2 includes a shaft metal 52 formed of a conductive material such as SUS; and a silicon rubber sponge 51 formed on the shaft metal 52.

In the embodiment, the silicon rubber sponge 51 is obtained through molding a silicon rubber compound with a protrusion method and the likes and thermally foaming the silicon rubber compound. The silicon rubber compound may include a rubber component such as a dimethyl silicone rubber, a methyl phenyl silicone rubber, and the likes. The silicon rubber compound may contain a reinforcement silica compound, and a cross-linking agent and a foaming agent for vulcanization and curing. The foaming agent may include an inorganic foaming agent such as sodium hydrogen carbonate and the likes and an organic foaming agent such as azodicarbon amid and the likes. Further, acetylene black or carbon black may be added to impart semi-conductivity. The toner supply roller 2 has cells with an opening (cell opening) having a diameter of, for example, 200 μm to 500 μm.

In the embodiment, it is possible to adjust the hardness of the toner supply roller 2 through a vinyl group concentration of the runner component, an amount of the reinforcement silica compound, am amount of the foaming agent, and a foaming ratio according to a catalyst amount of the cross-linking agent. For example, when the vinyl group concentration of the runner component increases, or the amount of the reinforcement silica compound increases, or the amount of the foaming agent decreases, or the foaming ratio decreases through increasing the catalyst amount of the cross-linking agent, it is possible to increase the hardness of the toner supply roller 2. When the vinyl group concentration of the runner component decreases, or the amount of the reinforcement silica compound decreases, or the amount of the foaming agent increases, or the foaming ratio increases through decreasing the catalyst amount of the cross-linking agent, it is possible to decrease the hardness of the toner supply roller 2.

As shown in FIG. 4, the toner supply roller 2 bits into the developing roller 1 by a biting amount or an overlap amount N (mm). The overlap amount N is calculated through the following equation:

$$N=((\Phi d+\Phi s)/2)-L1$$

where L1 (mm) is a distance between a center axis of the metal shaft 42 of the developing roller 1 and a center axis of the metal shaft 52 of the toner supply roller 2; Φd is an outer diameter of the developing roller 1; and Φs is an outer diameter of the toner supply roller 2. As shown in FIG. 4, the developing roller 1 contacts with the toner supply roller 2 over a nip width L2 (mm) between the developing roller 1 and the toner supply roller 2 in a sectional direction.

In the following description, an evaluation of the developing device will be explained. In the evaluation, a thickness D of the surface layer 41 of the developing roller 1, a ratio A of the acrylic resin of the developing roller 1, an Asker F hardness F of the toner supply roller 2, and the overlap amount N between the developing roller 1 and the toner supply roller 2 are varied. In the evaluation, half-tone stain, fog, a solid image density, and toner filming are evaluated.

First Embodiment

A first embodiment of the present invention will be explained next. In the first embodiment, the surface layer 41 of the developing roller 1 is formed of a mixture of an acrylic resin and a polyether type urethane resin. An experiment was conducted for evaluating the developing device.

In the experiment, the ratio or amount A1 of the acrylic resin of the developing roller 1 was set to 20%, 40%, 60% and 80%. The ratio A1 indicates a weight ratio of the acrylic resin relative to a total weight of the acrylic resin and the urethane resin. The thickness D of the surface layer 41 of the developing roller 1 was set to 0.6 μm, 1.0 μm, 1.5 μm, 2.0 μm, and 3.0 μm. The Asker F hardness F of the toner supply roller 2 was varied between 48 degrees and 62 degrees. The overlap amount N between the developing roller 1 and the toner supply roller 2 was set to 0.9 mm (the nip width L2 was 4.3 mm), 1.0 mm (the nip width L2 was 4.9 mm), and 1.1 mm (the nip width L2 was 5.4 mm). The developing device thus set was used for a printing operation for the evaluation.

In the experiment, the thickness D of the surface layer 41 of the developing roller 1 was determined through a sectional observation of the developing roller 1 using a scanning electron microscopy (SEM) at an acceleration voltage of 5 kV and a magnification of 5,000 times. The overlap amount N was adjusted through setting the outer diameter Φs of the toner supply roller 2 to 13.0 mm, 13.2 mm, and 13.4 mm.

In the experiment, the toner had a glass transition temperature of 60° C. to 65° C. and a softening point of 110° C. to 117° C. The toner was formed of at least a binder (binder resin). The binder was formed of a polyester resin, and may be formed of a styrene-acryl copolymer.

When the amount A1 of the acrylic resin was 0% or 10%, the developing roller abut against an abutting component with a large frictional force, thereby deteriorating the toner and causing a stain. When the amount A1 of the acrylic resin was 90% or 100%, the toner stuck to the developing roller 1 at a contact portion between the photosensitive drum 3 and the developing blade 6 after the developing device was placed for one week under a temperature of 45° C. and a relative humidity of 80%, thereby causing a lateral streak. For the above reason, the experiment was not conducted when the amount A1 of the acrylic resin was 0%, 10%, 90%, or 100%. Further, when the thickness D of the surface layer 41 was less than 3.0 μm, the toner filming and the density distribution were deteriorated, so that the experiment was not conducted.

In the experiment, the half-tone stain, the fog, the solid image density, and the toner filming were evaluated. When the developing device was used for the printing operation, the applied bias of the developing roller was −250 V, the applied bias of the toner supply roller was −270 V, the applied bias of the developing blade was −270 V, and the applied bias of the charging roller was −1,050 V.

Figure 5:
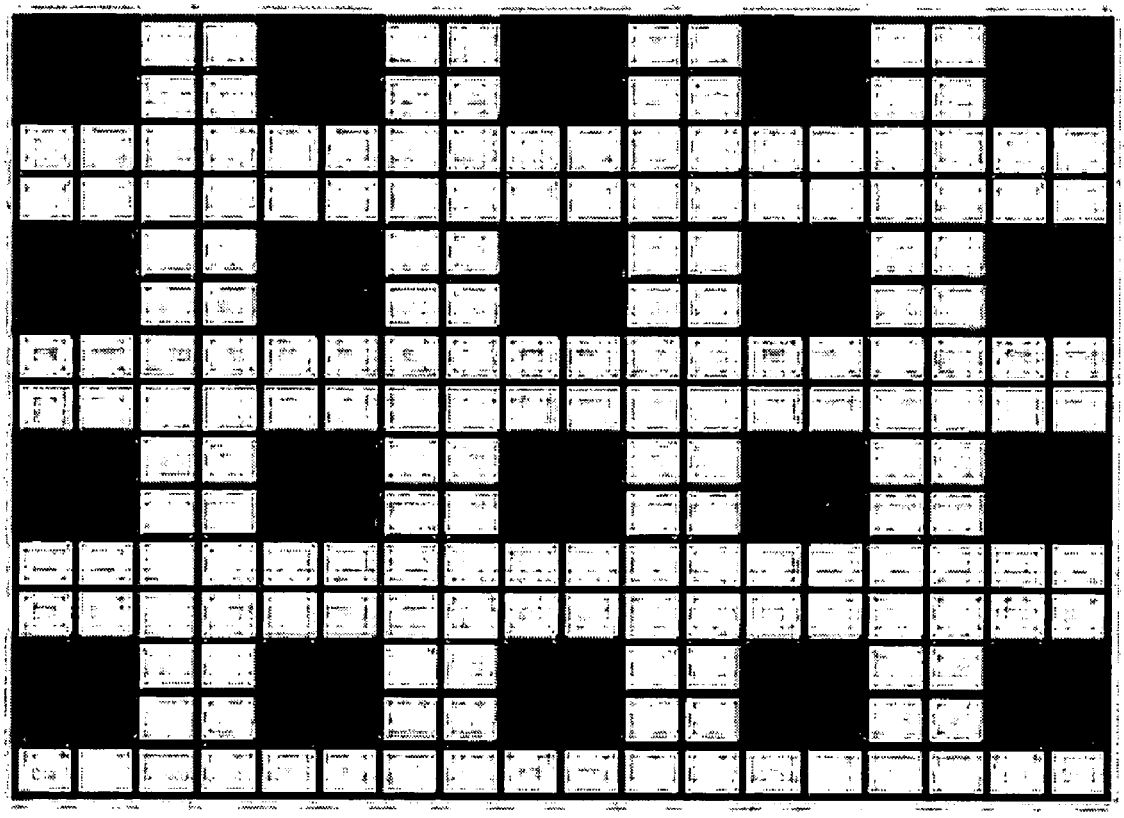
FIG. 5 is a schematic view showing a half-tone image of 2 by 2 dots according to the embodiment of the present invention.

FIG. 5 is a schematic view showing a half-tone image of 2 by 2 dots according to the first embodiment of the present invention. In the experiment, in order to evaluate the half-tone stain, the half-tone image shown in FIG. 5 was printed at a resolution of 600 dpi. The half-tone image included a dot of four boxes formed of two dots in a lateral direction and two dots in a vertical direction among sixteen boxes having four dots in the lateral direction and four dots in the vertical direction.

In general, a half-tone stain occurs when toner is excessively charged and developed in an unexposed area of a photosensitive drum, i.e., a white area where toner is not attached. More specifically, excessively charged toner with a high charge amount is attached to the white area, i.e., an area to be a background of an image or a no-image area. In printing the half-tone image, when toner is attached to the white area to be a stain, the area of tow-dot by two-dot of the half-tone image described above is smeared, thereby increasing a density of an entire print area.

In the experiment, in order to evaluate the half-tone stain, a density of the half-tone image at the beginning of the printing operation was measured with X-Rite 528 (a product of X-Rite Corp.). Next, the half-tone image was printed again after the developing roller rotated idle for about 11,000 rotations and the toner supply roller rotated idle for about 8,000 rotations corresponding to 1,000 A4 size sheets transported in a longitudinal direction. A different between the densities of the two half-tone images was determined relative to a standard when no stain was observed in forming the half-tone image. When the difference was less than 20%, the result was good. When the difference was more than 20%, the result was poor.

Figure 6:
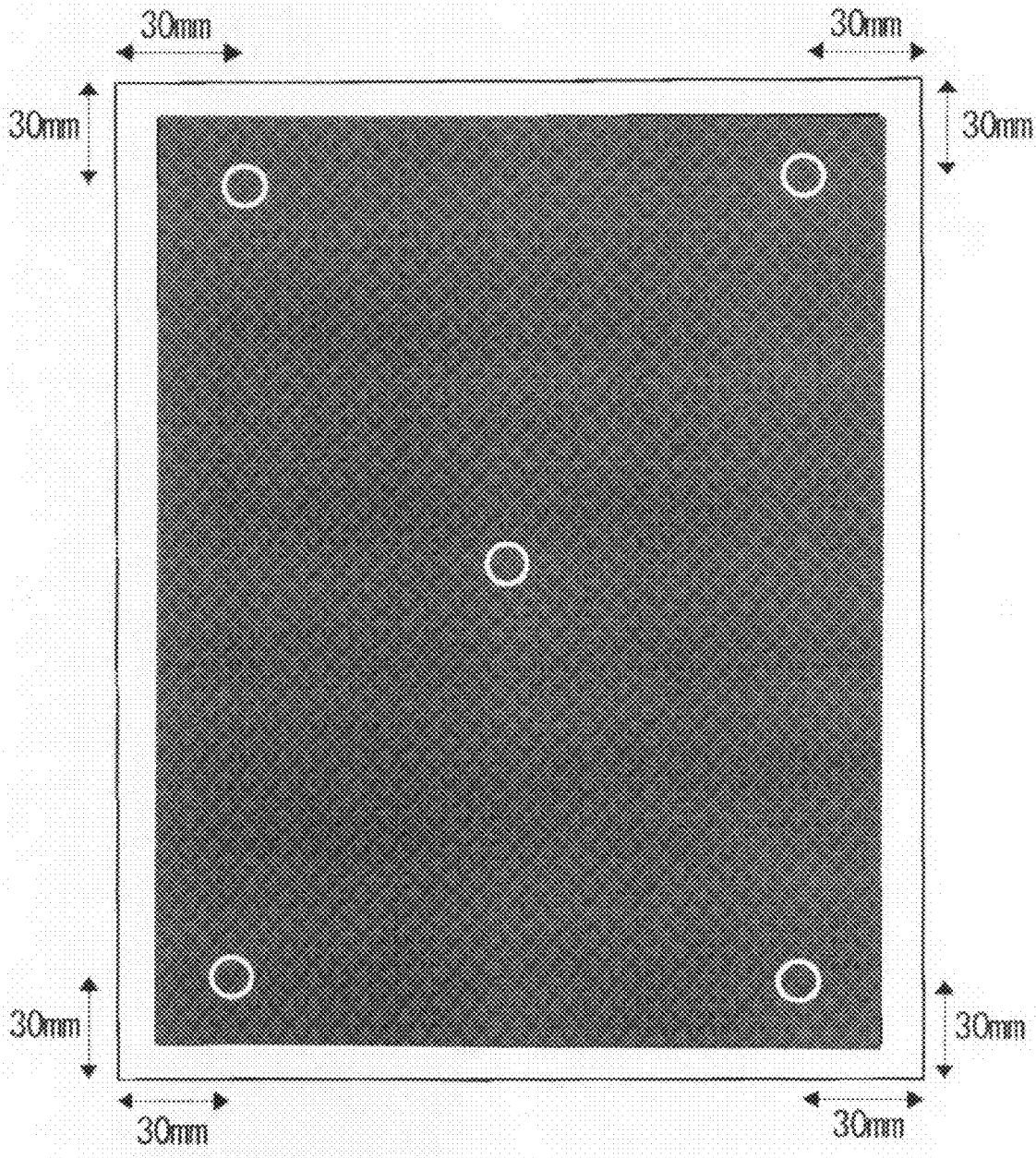
FIG. 6 is a schematic view showing a method of measuring a print density according to the embodiment of the present invention.

FIG. 6 is a schematic view showing a method of measuring a print density according to the first embodiment of the present invention. In the experiment, in order to evaluate the solid image density, as shown in FIG. 6, a solid image was printed on an entire printable area using the toner described above.

In general, at the beginning of a printing operation, toner in a developing device is not sufficiently charged, so that a sufficient amount of toner is not supplied to a developing roller, thereby reducing a density. Accordingly, in the experiment, in order to evaluate the solid image density, the solid image was printed at the beginning of the printing operation when the density thereof tends to be lower.

In evaluating the solid image density, X-Rite 528 (a product of X-Rite Corp.) was used to measure densities of the solid image at five locations indicated with circles, i.e., four locations inside from a corner of a sheet in a vertical direction and a lateral direction by 30 mm, and one location at the center of the sheet. An average of the densities at the fixed locations was determined to be the print density. When the print density was greater than 1.3, the result was good. When the print density was less than 1.3, the result was poor.

The toner filming is a phenomenon in which melted toner covers a surface of a developing roller. In order to evaluate the toner filming, after 10,000 A4 size sheets were printed (transported in a longitudinal direction), that corresponds to a state that the developing roller rotated idle for about 110,000 rotations and the toner supply roller rotated idle for about 80,000 rotations, the surface of the developing roller was observed with SEM. When the toner filming did not occur, the result was good. When the toner filming did occur, the result was poor.

The results of the evaluation are shown in Table 1 to Table 4.

TABLE 1

| Developer supporting member | | Toner supply roller | | | | | | |
|---|---|---|---|---|---|---|---|---|
| Acrylic ratio A1 (%) | Thickness D (μm) | Hardness F | Overlap amount N (mm) | F × N | Half-tone stain | Fog | Solid density | Toner filming |
| 20 | 0.6 | 51 | 0.9 | 46 | Poor | Good | Good | Good |
| | 1.5 | | | | Poor | Good | Good | Good |
| | 3.0 | | | | Poor | Good | Good | Good |
| | 1.0 | 52 | 0.9 | 47 | Good | Good | Good | Good |
| | 0.6 | 48 | 1.0 | 48 | Good | Good | Good | Good |
| | 1.5 | | | | Good | Good | Good | Good |
| | 3.0 | | | | Poor | Good | Good | Good |
| | 0.6 | 50 | 1.0 | 50 | Good | Good | Good | Good |
| | 1.5 | | | | Good | Good | Good | Good |
| | 3.0 | | | | Poor | Good | Good | Good |
| | 0.6 | 56 | 0.9 | 50 | Good | Good | Good | Good |
| | 1.5 | | | | Good | Good | Good | Good |
| | 3.0 | | | | Poor | Good | Good | Good |
| | 3.0 | 57 | 0.9 | 51 | Good | Good | Good | Good |
| | 3.0 | 51 | 1.0 | | Good | Good | Good | Good |
| | 0.6 | 49 | 1.1 | 54 | Good | Good | Good | Good |
| | 1.5 | | | | Good | Good | Good | Good |
| | 3.0 | | | | Good | Good | Good | Good |
| | 0.6 | 54 | 1.0 | 54 | Good | Good | Good | Good |
| | 1.5 | | | | Good | Good | Good | Good |
| | 3.0 | | | | Good | Good | Good | Good |
| | 0.6 | 60 | 0.9 | 54 | Good | Good | Good | Good |
| | 1.5 | | | | Good | Good | Good | Good |
| | 3.0 | | | | Good | Good | Good | Good |
| | 0.6 | 56 | 1.1 | 62 | Good | Good | Good | Good |
| | 1.5 | | | | Good | Good | Good | Good |
| | 3.0 | | | | Good | Good | Good | Good |
| | 0.6 | 62 | 1.0 | 62 | Good | Good | Good | Good |
| | 1.5 | | | | Good | Good | Good | Good |
| | 3.0 | | | | Good | Good | Good | Good |
| | 0.6 | 59 | 1.1 | 65 | Good | Good | Good | Good |
| | 1.5 | | | | Good | Good | Good | Good |
| | 3.0 | | | | Good | Good | Good | Good |

TABLE 2

| Developer supporting member | | Toner supply roller | | | | | | |
|---|---|---|---|---|---|---|---|---|
| Acrylic ratio A1 (%) | Thickness D (μm) | Hardness F | Overlap amount N (mm) | F × N | Half-tone stain | Fog | Solid density | Toner filming |
| 40 | 0.6 | 51 | 0.9 | 46 | Poor | Good | Good | Good |
| | 1.5 | | | | Poor | Good | Good | Good |
| | 3.0 | | | | Poor | Good | Good | Good |
| | 0.6 | 48 | 1.0 | 48 | Good | Good | Good | Good |
| | 1.5 | | | | Poor | Good | Good | Good |
| | 1.0 | 49 | 1.0 | 49 | Good | Good | Good | Good |
| | 0.6 | 50 | 1.0 | 50 | Good | Good | Good | Good |
| | 1.0 | | | | Good | Good | Good | Good |
| | 1.5 | | | | Poor | Good | Good | Good |
| | 3.0 | | | | Poor | Good | Good | Good |
| | 0.6 | 56 | 0.9 | 50 | Good | Good | Good | Good |
| | 1.0 | | | | Good | Good | Good | Good |
| | 1.5 | | | | Poor | Good | Good | Good |
| | 3.0 | | | | Poor | Good | Good | Good |
| | 2.0 | 53 | 1.0 | 53 | Good | Good | Good | Good |
| | 0.6 | 49 | 1.1 | 54 | Good | Good | Good | Good |
| | 1.0 | | | | Good | Good | Good | Good |
| | 1.5 | | | | Good | Good | Good | Good |
| | 3.0 | | | | Poor | Good | Good | Good |
| | 0.6 | 54 | 1.0 | 54 | Good | Good | Good | Good |
| | 1.0 | | | | Good | Good | Good | Good |
| | 1.5 | | | | Good | Good | Good | Good |
| | 3.0 | | | | Poor | Good | Good | Good |
| | 0.6 | 60 | 0.9 | 54 | Good | Good | Good | Good |
| | 1.0 | | | | Good | Good | Good | Good |
| | 1.5 | | | | Good | Good | Good | Good |
| | 3.0 | | | | Poor | Good | Good | Good |
| | 3.0 | 56 | 1.0 | 56 | Poor | Good | Good | Good |
| | 3.0 | 52 | 1.1 | 57 | Good | Good | Good | Good |
| | 0.6 | 56 | 1.1 | 62 | Good | Good | Good | Good |
| | 1.5 | | | | Good | Good | Good | Good |
| | 3.0 | | | | Good | Good | Good | Good |
| | 0.6 | 62 | 1.0 | 62 | Good | Good | Good | Good |
| | 1.5 | | | | Good | Good | Good | Good |
| | 3.0 | | | | Good | Good | Good | Good |
| | 0.6 | 59 | 1.1 | 65 | Good | Good | Good | Good |
| | 1.5 | | | | Good | Good | Good | Good |
| | 3.0 | | | | Good | Good | Good | Good |

TABLE 3

| Developer supporting member | | Toner supply roller | | | | | | |
|---|---|---|---|---|---|---|---|---|
| Acrylic ratio A1 (%) | Thickness D (μm) | Hardness F | Overlap amount N (mm) | F × N | Half-tone stain | Fog | Solid density | Toner filming |
| 60 | 0.6 | 51 | 0.9 | 46 | Poor | Good | Good | Good |
| | 1.5 | | | | Poor | Good | Good | Good |
| | 3.0 | | | | Poor | Good | Good | Good |
| | 0.6 | 48 | 1.0 | 48 | Poor | Good | Good | Good |
| | 1.5 | | | | Poor | Good | Good | Good |
| | 0.6 | 50 | 1.0 | 50 | Good | Good | Good | Good |
| | 1.0 | | | | Poor | Good | Good | Good |
| | 1.5 | | | | Poor | Good | Good | Good |
| | 3.0 | | | | Poor | Good | Good | Good |
| | 0.6 | 56 | 0.9 | 50 | Good | Good | Good | Good |
| | 1.0 | | | | Poor | Good | Good | Good |
| | 1.5 | | | | Poor | Good | Good | Good |
| | 3.0 | | | | Poor | Good | Good | Good |
| | 1.0 | 51 | 1.0 | 51 | Good | Good | Good | Good |
| | 0.6 | 49 | 1.1 | 54 | Good | Good | Good | Good |
| | 1.0 | | | | Good | Good | Good | Good |
| | 1.5 | | | | Good | Good | Good | Good |
| | 2.0 | | | | Poor | Good | Good | Good |
| | 0.6 | 54 | 1.0 | 54 | Good | Good | Good | Good |
| | 1.0 | | | | Good | Good | Good | Good |
| | 1.5 | | | | Good | Good | Good | Good |
| | 2.0 | | | | Poor | Good | Good | Good |

TABLE 3-continued

| Developer supporting member | | Toner supply roller | | | | | | |
|---|---|---|---|---|---|---|---|---|
| Acrylic ratio A1 (%) | Thickness D (μm) | Hardness F | Overlap amount N (mm) | F × N | Half-tone stain | Fog | Solid density | Toner filming |
| | 0.6 | 60 | 0.9 | 54 | Good | Good | Good | Good |
| | 1.0 | | | | Good | Good | Good | Good |
| | 1.5 | | | | Good | Good | Good | Good |
| | 2.0 | | | | Poor | Good | Good | Good |
| | 3.0 | 56 | 1.0 | 56 | Poor | Good | Good | Good |
| | 2.0 | 58 | 1.0 | 58 | Good | Good | Good | Good |
| | 3.0 | | | | Poor | Good | Good | Good |
| | 0.6 | 56 | 1.1 | 62 | Good | Good | Good | Good |
| | 1.5 | | | | Good | Good | Good | Good |
| | 3.0 | | | | Poor | Good | Good | Good |
| | 0.6 | 62 | 1.0 | 62 | Good | Good | Good | Good |
| | 1.5 | | | | Good | Good | Good | Good |
| | 3.0 | | | | Poor | Good | Good | Good |
| | 3.0 | 57 | 1.1 | 63 | Good | Good | Good | Good |
| | 0.6 | 59 | 1.1 | 65 | Good | Good | Good | Good |
| | 1.5 | | | | Good | Good | Good | Good |
| | 3.0 | | | | Good | Good | Good | Good |

TABLE 4

| Developer supporting member | | Toner supply roller | | | | | | |
|---|---|---|---|---|---|---|---|---|
| Acrylic ratio A1 (%) | Thickness D (μm) | Hardness F | Overlap amount N (mm) | F × N | Half-tone stain | Fog | Solid density | Toner filming |
| 80 | 0.6 | 51 | 0.9 | 46 | Poor | Good | Good | Good |
| | 1.5 | | | | Poor | Good | Good | Good |
| | 3.0 | | | | Poor | Good | Good | Good |
| | 0.6 | 48 | 1.0 | 48 | Poor | Good | Good | Good |
| | 1.5 | | | | Poor | Good | Good | Good |
| | 0.6 | 50 | 1.0 | 50 | Good | Good | Good | Good |
| | 1.0 | | | | Poor | Good | Good | Good |
| | 1.5 | | | | Poor | Good | Good | Good |
| | 3.0 | | | | Poor | Good | Good | Good |
| | 0.6 | 56 | 0.9 | 50 | Good | Good | Good | Good |
| | 1.0 | | | | Poor | Good | Good | Good |
| | 1.5 | | | | Poor | Good | Good | Good |
| | 3.0 | | | | Poor | Good | Good | Good |
| | 0.6 | 49 | 1.1 | 54 | Good | Good | Good | Good |
| | 1.0 | | | | Good | Good | Good | Good |
| | 1.5 | | | | Poor | Good | Good | Good |
| | 2.0 | | | | Poor | Good | Good | Good |
| | 0.6 | 54 | 1.0 | 54 | Good | Good | Good | Good |
| | 1.0 | | | | Good | Good | Good | Good |
| | 1.5 | | | | Poor | Good | Good | Good |
| | 2.0 | | | | Poor | Good | Good | Good |
| | 0.6 | 60 | 0.9 | 54 | Good | Good | Good | Good |
| | 1.0 | | | | Good | Good | Good | Good |
| | 1.5 | | | | Poor | Good | Good | Good |
| | 2.0 | | | | Poor | Good | Good | Good |
| | 3.0 | 56 | 1.0 | 56 | Poor | Good | Good | Good |
| | 1.5 | 52 | 1.1 | 57 | Good | Good | Good | Good |
| | 2.0 | 58 | 1.0 | 58 | Poor | Good | Good | Good |
| | 3.0 | | | | Poor | Good | Good | Good |
| | 2.0 | 61 | 1.0 | 61 | Good | Good | Good | Good |
| | 0.6 | 56 | 1.1 | 62 | Good | Good | Good | Good |
| | 1.5 | | | | Good | Good | Good | Good |
| | 3.0 | | | | Poor | Good | Good | Good |
| | 0.6 | 62 | 1.0 | 62 | Good | Good | Good | Good |
| | 1.5 | | | | Good | Good | Good | Good |
| | 3.0 | | | | Poor | Good | Good | Good |
| | 0.6 | 59 | 1.1 | 65 | Good | Good | Good | Good |
| | 1.5 | | | | Good | Good | Good | Good |
| | 2.0 | | | | Good | Good | Good | Good |
| | 3.0 | | | | Poor | Good | Good | Good |

As shown in Table 1 to Table 4, when the developing roller had the thickness D less than 3.0 μm, the toner filming on the surface of the developing roller 1 did not occur, and the fog was good. Even after 10,000 sheets were printed, it was confirmed from the SEM observation that the surface layer still remained on the developing roller 1.

Figure 7:
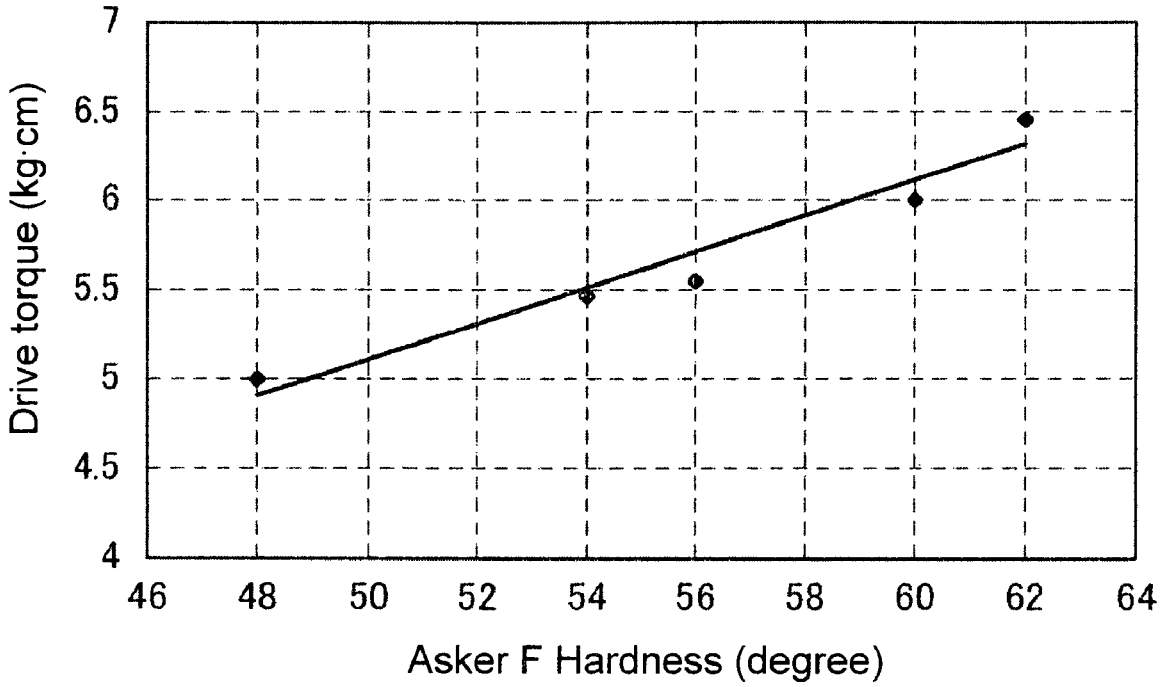
FIG. 7 is a graph showing a relationship between an Asker F hardness F of the toner supply roller and a drive torque of the developing device according to a first embodiment of the present invention.
Figure 8:
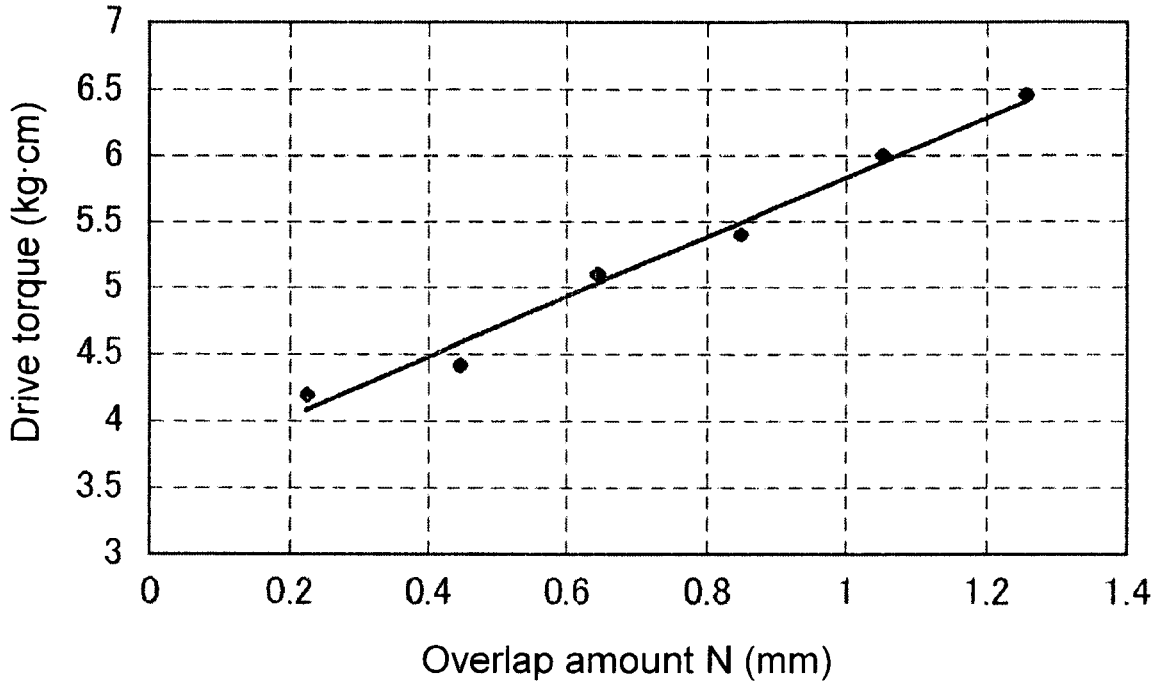
FIG. 8 is a graph showing a relationship between an overlap amount N of the toner supply roller and the drive torque of the developing device according to the first embodiment of the present invention.

FIG. 7 is a graph showing a relationship between the Asker F hardness F of the toner supply roller and a drive torque of the developing device according to the first embodiment of the present invention. FIG. 8 is a graph showing a relationship between the overlap amount N of the toner supply roller relative to the developing roller and the drive torque of the developing device according to the first embodiment of the present invention.

In the experiment, the drive torque was at a level necessary for rotating the photosensitive drum at a circumferential speed of, for example, 93.7 mm/s. As shown in FIGS. 7 and 8, the drive torque increases in proportional to the Asker F hardness F of the toner supply roller and the overlap amount N of the toner supply roller relative to the developing roller. In consideration of an influence on the drive motor of the image forming apparatus, it is preferred that the drive torque is less than 7 kg·cm. When the drive torque is larger than 7 kg·cm, a large drive force is necessary, and it is difficult to rotate the photosensitive drum. As shown in FIGS. 7 and 8, when a product of the Asker F hardness F and the overlap amount N is less than 65, the drive torque becomes less than 7 kg·cm.

Figure 9:
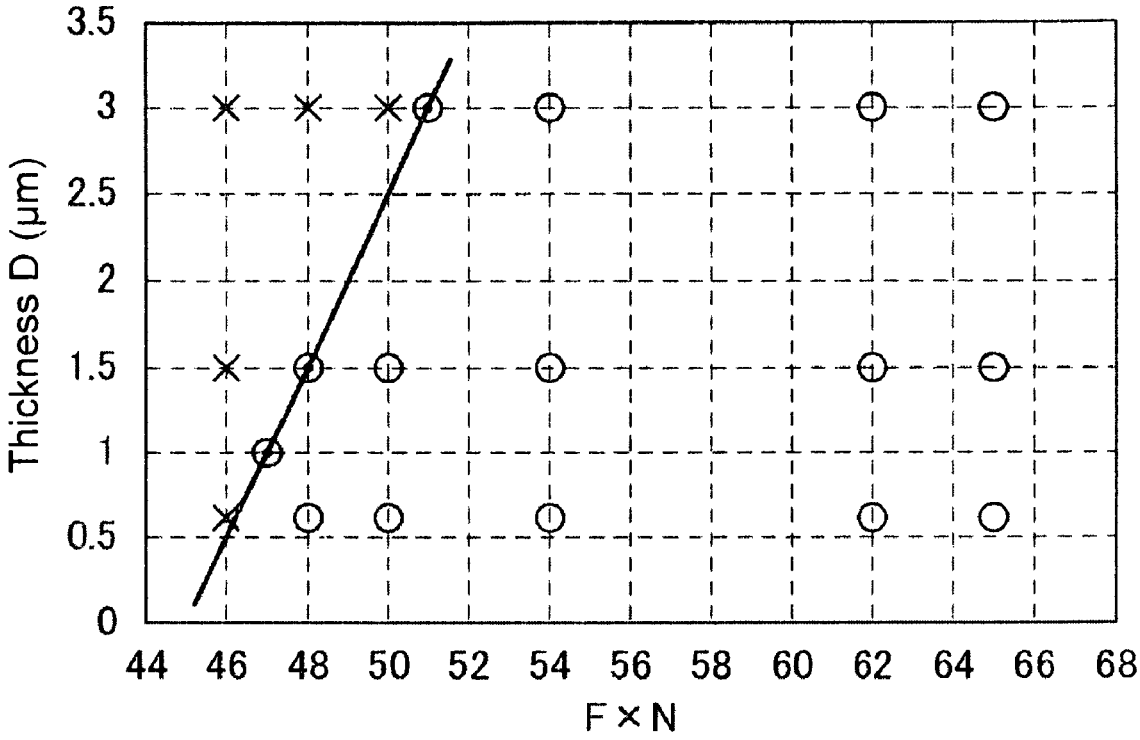
FIG. 9 is a graph showing a relationship between a thickness D of a surface layer and a product of the Asker F hardness F and the overlap amount N (F×N) in a case that an amount A of an acrylic resin is 20% according to the first embodiment of the present invention.
Figure 10:
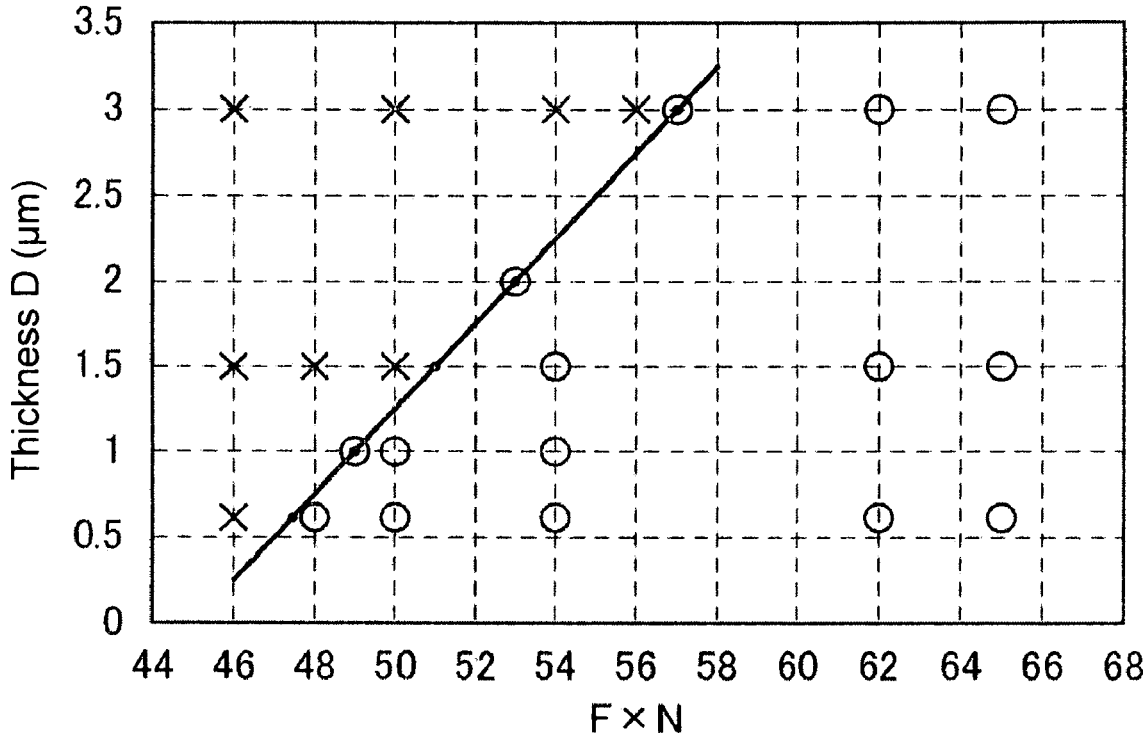
FIG. 10 is a graph showing a relationship between the thickness D of the surface layer and the product of the Asker F hardness F and the overlap amount N (F×N) in a case that the amount A of the acrylic resin is 40% according to the first embodiment of the present invention.
Figure 11:
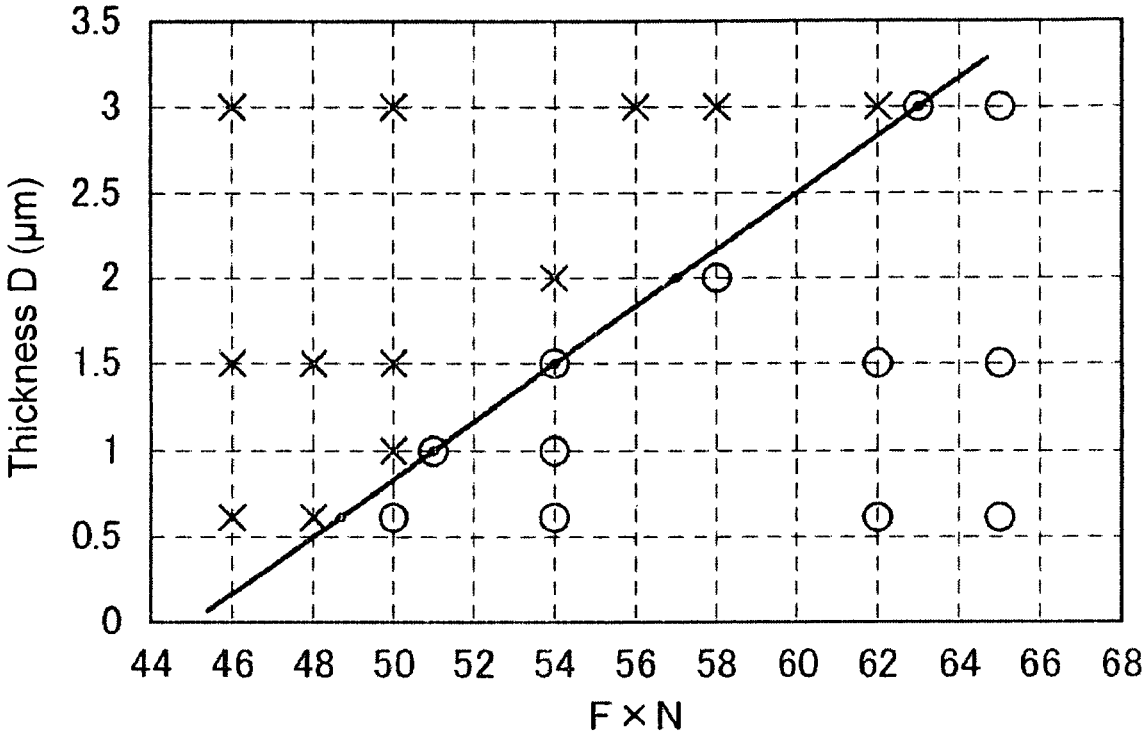
FIG. 11 is a graph showing a relationship between the thickness D of the surface layer and the product of the Asker F hardness F and the overlap amount N (F×N) in a case that the amount A of the acrylic resin is 60% according to the first embodiment of the present invention.
Figure 12:
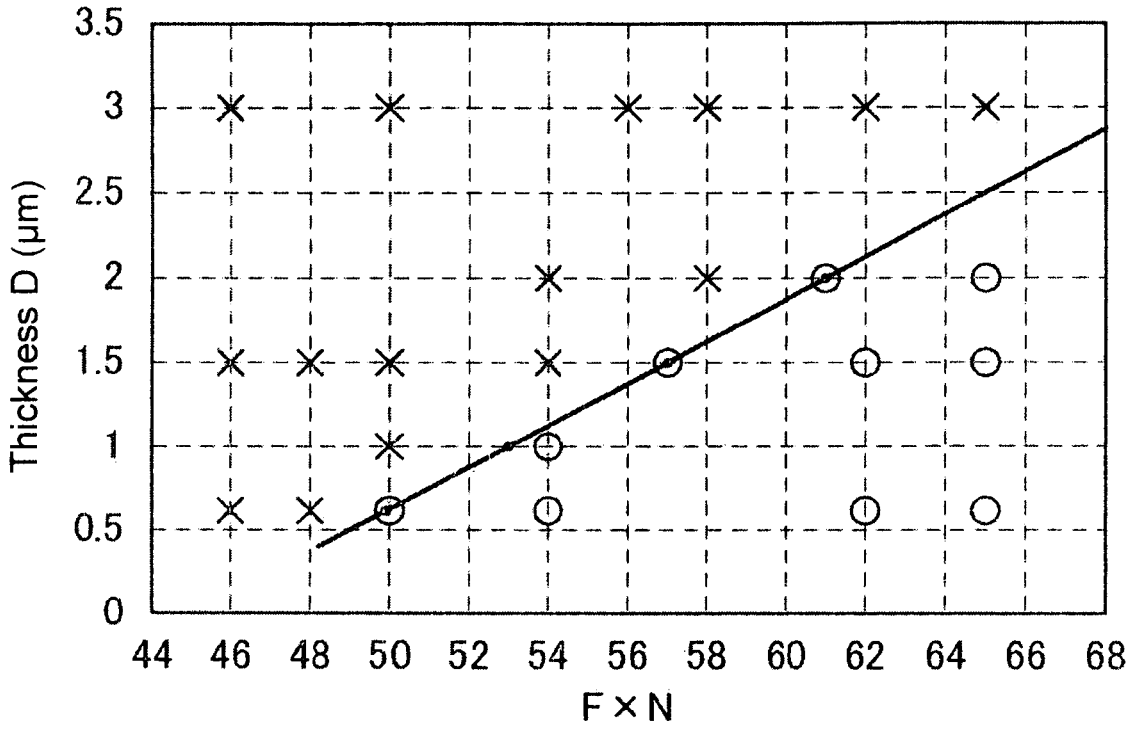
FIG. 12 is a graph showing a relationship between the thickness D of the surface layer and the product of the Asker F hardness F and the overlap amount N (F×N) in a case that the amount A of the acrylic resin is 80% according to the first embodiment of the present invention.

FIG. 9 is a graph showing a relationship between the thickness D of the surface layer and the product of the Asker F hardness F and the overlap amount N (F×N) in a case that the amount A1 of the acrylic resin is 20% according to the first embodiment of the present invention. FIG. 10 is a graph showing a relationship between the thickness D of the surface layer and the product of the Asker F hardness F and the overlap amount N (F×N) in a case that the amount A1 of the acrylic resin is 40% according to the first embodiment of the present invention. FIG. 11 is a graph showing a relationship between the thickness D of the surface layer and the product of the Asker F hardness F and the overlap amount N (F×N) in a case that the amount A1 of the acrylic resin is 60% according to the first embodiment of the present invention. FIG. 12 is a graph showing a relationship between the thickness D of the surface layer and the product of the Asker F hardness F and the overlap amount N (F×N) in a case that the amount A1 of the acrylic resin is 80% according to the first embodiment of the present invention; and In FIGS. 9 to 12, an empty circle represents the good evaluation result of the half-tone stain, and an X mark represents the poor evaluation result of the half-tone stain corresponding to Table 1 to Table 4.

As shown in FIGS. 9 to 12, there is a boundary represented with a solid straight line between an area where the half-tone stain occurred and an area where the half-tone stain did not occur. When the amount A1 of the acrylic resin is 20%, the solid straight line is expressed as 2D=F×N−45. When the amount A1 of the acrylic resin is 40%, the solid straight line is expressed as 4D=F×N−45. When the amount A1 of the acrylic resin is 60%, the solid straight line is expressed as 6D=F×N−45. When the amount A1 of the acrylic resin is 80%, the solid straight line is expressed as 8D=F×N−45. From the relationship between the solid straight line and the amount A1 of the acrylic resin, the following equation is obtained:

$$0.1\times A1\times D=F\times N-45$$

where A1 is the weight ratio (%) of the acrylic resin, F is the Asker F hardness (degree) of the surface layer, and N is the overlap amount (mm).

In consideration of the influence on the drive motor of the image forming apparatus, it is preferred that the following equation is satisfied:

$$45+0.1\times A1\times D\leqq F\times N\leqq 65$$

where A1 is the weight ratio (%) of the acrylic resin, F is the Asker F hardness (degree) of the surface layer, and N is the overlap amount (mm).

As shown in FIGS. 9 to 12, when the amount A1 of the acrylic resin was 20%, 40%, or 60%, there was an area where the half-tone stain did not occur even the thickness D of the surface layer is 3.0 μm. When the amount A1 of the acrylic resin was 80%, there is an area where the half-tone stain did not occur when the thickness D of the surface layer was less than 2.0 μm.

In other words, when the amount A1 of the acrylic resin was more than 20% and less than 80%, the half-tone stain did not occur when the thickness D of the surface layer was greater than 0.6 μm and less than 2.0 μm. Accordingly, the stain does not occur and the drive torque of the developing device is good when the following equations are satisfied:

$$20\leqq A1\leqq 80$$

$$0.6\leqq D\leqq 2.0$$

$$45+0.1\times A1\times D\leqq F\times N\leqq 65$$

where A1 is the weight ratio (%) of the acrylic resin, F is the Asker F hardness (degree) of the surface layer, and N is the overlap amount (mm).

It is considered that when the amount A1 of the acrylic resin is more than 80%, the toner on the developing roller 1 is excessively charged, thereby narrowing the optimal area with respect to the stain and the drive torque of the developing device.

Figure 13:
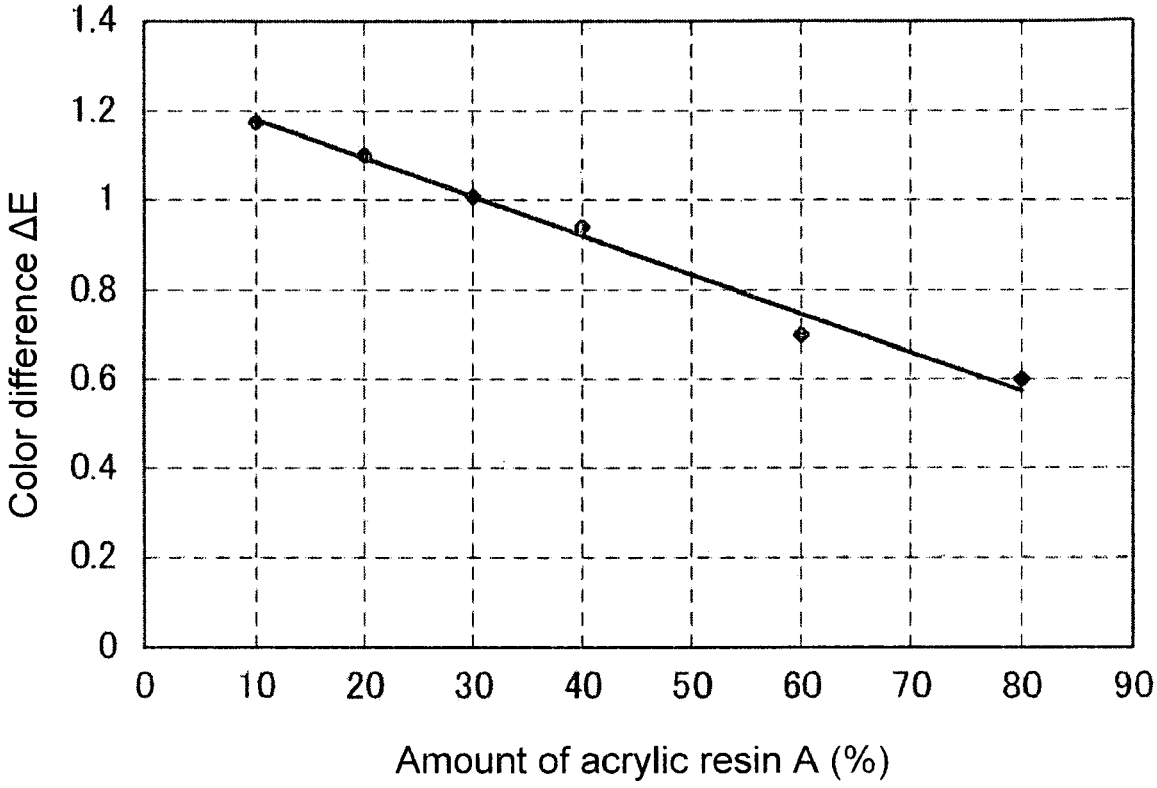
FIG. 13 is a graph showing a relationship between a color difference ΔE and the amount A of the acrylic resin according to the first embodiment of the present invention.

FIG. 13 is a graph showing a relationship between the color difference ΔE and the amount A1 of the acrylic resin according to the first embodiment of the present invention.

As shown in FIG. 13, when the amount A1 of the acrylic resin increased, the toner 5 was properly charged, thereby improving the fog. When the amount A1 of the acrylic resin was less than 20%, the color difference ΔE became close to the upper limit (ΔE<1.5). Accordingly, when the amount A1 of the acrylic resin was more than 40% and less than 80%, the fog was improved. Further, while the above equations are satisfied, when the overlap amount N is greater than 1.0 mm and less than 1.1 mm (the nip width L2 between 4.9 mm and 5.4 mm), it is possible to improve the fog and the stain.

As described above, in the embodiment, when the amount A1 of the acrylic resin, the thickness D of the surface layer, the Asker F hardness F, and the overlap amount N satisfy the above equations, it is possible to provide the developing device capable of forming an image with less fog and without stain and filming. Further, when the image forming apparatus includes the developing device, it is possible to form an image with less fog and without stain and filming.

Second Embodiment

A second embodiment of the present invention will be explained next. In the second embodiment, different from the first embodiment, in which the surface layer of the developing roller is formed of the acrylic resin and the polyether type urethane resin, the surface layer of the developing roller is formed of an acrylic resin and a polyester type urethane resin.

An experiment was conducted for evaluating the developing device. In the experiment, the thickness D of the surface layer 41 of the developing roller 1 was set to 1.5 μm. The amount A2 of the acrylic resin of the developing roller 1 was set to 20%, 40%, 60%, and 80%. The developing roller 1 was pushed into the photosensitive drum 3 by 0.1 mm, and the developing blade 6 pressed with a pressing force of 900 g. The toner had a glass transition temperature of 60° C. to 65° C. and a softening point of 110° C. to 117° C. The toner included at least a binder formed of a polyester resin.

In the second embodiment, a storage test of the developing roller 1 was conducted, and a surface roughness Rz (μm) thereof was evaluated. The storage test simulated a state that the developing device was placed without using. In general, toner may be melted and sticks to a surface of a developing roller at a contact point between the developing roller and a photosensitive drum, and a contact point between the developing roller and a developing blade due to a contact pressure, a temperature, and humidity. The storage test was conducted to determine whether the above phenomenon occurred.

In the storage test, the image forming unit with the developing roller described above was placed under a temperature of 50° C. and a relative humidity of 51% for one week. Afterward, the solid image and the half-tone image of the 2 by 2 pattern were printed. It was determined whether a streak was created in the images thus formed due to the toner sticking to the developing roller 1. When the streak was created, the result was good. When the streak was created, the result was poor.

The surface roughness Rz is an indicator of a roughness of the surface of the developing roller 1. The surface roughness Rz was measured along the circumferential direction of the developing roller 1 with Surfcoder SEF3500 (a product of Kosaka Laboratory Ltd.) before and after 10,000 sheets were printed, and a difference thereof was determined.

The result of the storage test is shown in Table 5.

TABLE 5

| Surface layer | | | | | | |
|---|---|---|---|---|---|---|
| Acrylic ratio A1 or A2 (%) | Thickness D (μm) | Urethane type | Storage test | Surface roughness Rz (μm) Before | After | Difference |
| 20 | 1.5 | Polyether type | Good | 6.0 | 4.5 | 1.5 |
| 40 | 1.5 | | Good | — | — | — |
| 60 | 1.5 | | Good | — | — | — |
| 80 | 1.5 | | Good | 5.8 | 5.0 | 0.8 |
| 20 | 1.5 | Polyester type | Poor | 6.9 | 6.2 | 0.7 |
| 40 | 1.5 | | Good | — | — | — |
| 60 | 1.5 | | Good | — | — | — |
| 80 | 1.5 | | Good | 5.2 | 4.9 | 0.3 |

As shown in Table 5, when the surface layer of the developing roller 1 was formed of the acrylic resin and the polyester type urethane resin, and the amount A2 of the acrylic resin was 20%, it was confirmed that the toner stuck to the contact point between the developing roller and the photosensitive drum and the contact point between the developing roller and the developing blade.

It is considered that the result is attributed to the fact that the toner contained the polyester resin, and the polyester type urethane resin has a molecular structure such as an ester bond similar to the main component of the toner, thereby increasing compatibility of the polyester type urethane resin. On the other hand, in the case of the polyether type urethane resin, it was not confirmed that the toner stuck regardless of the amount A1 of the acrylic resin. Further, even when the surface layer was formed of the polyester type urethane resin, when the amount A2 of the acrylic resin was large, it was not confirmed that the toner stuck.

As shown in Table 5, when the surface layer was formed of the acrylic resin and the polyester type urethane resin, the difference in the surface roughness Rz of the developing roller between the beginning of the printing operation and after 10,000 sheets were printed was smaller than that of the surface layer formed of the acrylic resin and the polyether type urethane resin.

In general, a surface layer of a developing roller abuts against an abutting component such as a photosensitive drum and a developing blade, so that an undulation of the surface layer becomes smooth, thereby reducing a roughness thereof. As shown in Table 5, it is confirmed that the surface layer formed of the acrylic resin and the polyester type urethane resin had a less wear amount and a higher mechanical strength than the surface layer formed of the acrylic resin and the polyether type urethane resin.

In the experiment, the printing test similar to the first embodiment was conducted with respect to the developing roller 1. As a result, it was confirmed that a good image was formed with less fog and without stain and filming. That is, when the amount A2 of the acrylic resin, the thickness D of the surface layer, the Asker F hardness F, and the overlap amount N satisfy the above equations, it is possible to obtain the good result using the polyester type urethane resin. Accordingly, when the overlap amount N of the toner supply roller 2 is greater than 1.0 mm and less than 1.1 mm (the nip width L2 between 4.9 mm and 5.4 mm), it is possible to improve the fog and the stain.

As described above, in the embodiment, the surface layer of the developing roller is formed of the acrylic resin and the polyester type urethane resin. Further, the amount of the acrylic resin is set between 40% and 80%. As a result, the surface layer has a higher mechanical strength, thereby reducing a change in the surface roughness thereof with time. Further, even when the toner contains the polyester resin as the main component thereof, it is possible to prevent the toner from sticking and maintain good storage ability, thereby making it possible to form a good image for a long period of time.

The disclosure of Japanese Patent Application No. 2008-013170, filed on Jan. 23, 2008, is incorporated in the application.

While the invention has been explained with reference to the specific embodiments of the invention, the explanation is illustrative and the invention is limited only by the appended claims.

What is claimed is:

1. A developing device comprising:

a developer supporting member having an elastic layer and a surface layer covering the elastic layer; and a supply member contacting with the developer supporting member for supplying developer to the developer supporting member, said surface layer being formed of a mixture containing at least an acrylic resin and a polyether type urethane resin, said developer supporting member and said supply member being configured so that the following equations are satisfied:

$$20 \leqq A1 \leqq 80$$

$$0.6 \leqq D \leqq 2.0$$

$$45 + 0.1 \times A1 \times D \leqq F \times N \leqq 65$$

where A1 is a weight ratio (%) of the acrylic resin relative to a total weight of the acrylic resin and the polyether type urethane resin, D is a thickness of the surface layer, F is an Asker F hardness (degree) of a surface of the supply member, and N is an overlap amount (mm) representing a biting amount of the supply member relative to the developer supporting member.

2. The developing device according to claim 1, wherein said developer supporting member and said supply member are configured so that the overlap amount N satisfies the following equation:

$$1.0 \leqq N \leqq 1.1.$$

3. An image forming apparatus comprising the developing device according to claim 1.

4. A developing device comprising:

a developer supporting member having an elastic layer and a surface layer coveting the elastic layer; and a supply member contacting with the developer supporting member for supplying developer to the developer supporting member, said surface layer being formed of a mixture containing at least an acrylic resin and a polyester type urethane resin, said developer supporting member and said supply member being configured so that the following equations are satisfied:

$$40 \leqq A2 \leqq 80$$

$$0.6 \leqq D \leqq 2.0$$

$$45 + 0.1 \times A2 \times D \leqq F \times N \leqq 65$$

where A2 is a weight ratio (%) of the acrylic resin relative to a total weight of the acrylic resin and the polyester type urethane resin, D is a thickness of the surface layer, F is an Asker F hardness (degree) of a surface of the supply member, and N is an overlap amount (mm) representing a biting amount of the supply member relative to the developer supporting member.

5. The developing device according to claim 4, wherein said developer supporting member and said supply member are configured so that the overlap amount N satisfies the following equation:

$$1.0 \leqq N \leqq 1.1.$$

6. An image forming apparatus comprising the developing device according to claim 4.

* * * * *